United States Patent [19]

Moriwaki et al.

[11] 4,364,617

[45] Dec. 21, 1982

[54] METHOD AND APPARATUS FOR STABILIZING THE PRESSURE OF A GAS IN A CLOSED BODY

[75] Inventors: Takeshi Moriwaki; Shinichi Tsunekawa, both of Yokohama, Japan

[73] Assignee: Tokyo Shibaura Denki Kabushiki Kaisha, Kawasaki, Japan

[21] Appl. No.: 196,763

[22] PCT Filed: Oct. 11, 1979

[86] PCT No.: PCT/JP79/00258

§ 371 Date: Jun. 13, 1980

§ 102(e) Date: Jun. 11, 1980

[87] PCT Pub. No.: WO80/00896

PCT Pub. Date: May 1, 1980

[30] Foreign Application Priority Data

Oct. 13, 1978 [JP] Japan ..... 53-125866

[51] Int. Cl.[3] ..... H01J 9/395

[52] U.S. Cl. ..... 316/24; 141/66; 316/30

[58] Field of Search ..... 316/24, 27, 30; 141/8, 141/65, 66

[56] References Cited

U.S. PATENT DOCUMENTS

| | | | |
|---|---|---|---|
| 2,215,100 | 9/1940 | Gustin | 141/66 X |
| 2,542,636 | 2/1951 | DeGroat | 141/66 |
| 3,589,790 | 6/1971 | Beane | 316/24 X |
| 3,598,518 | 8/1971 | Goto | 141/66 X |
| 3,967,871 | 7/1976 | Kerekes | 316/30 X |

*Primary Examiner*—Gil Weidenfeld
*Assistant Examiner*—Fred A. Silverberg
*Attorney, Agent, or Firm*—Cushman, Darby & Cushman

[57] ABSTRACT

An apparatus for stabilizing the pressure of a seal gas includes a hollow body (10) having a first pipe (11) with a conductance $C_1$, a second pipe (12) with a conductance $C_2$ and a third pipe (13) with a conductance $C_3$, all these pipes communicating with each other. The conductance $C_1$ is smaller than either of the conductances $C_2$ and $C_3$. The first pipe (11) is connected to a source (15) of the same kind of gas as a desired gas to be sealed in the tubular bulb (1), the second pipe (12) is connected to a decompressing system (17), and the third pipe (13) is connected to the tubular bulb (1). In accordance with both the apparatus and method according to the present invention, the conductances $C_1$ and $C_2$ are so set that a gas pressure in the third pipe (13) may be made equal to or lower than a desired pressure to be attained in the tubular bulb (1) under conditions wherein the gas from the gas source (15) constantly flows from the first pipe to the second pipe.

3 Claims, 2 Drawing Figures

METHOD AND APPARATUS FOR STABILIZING THE PRESSURE OF A GAS IN A CLOSED BODY

TECHNICAL FIELD

This invention relates to an apparatus for stabilizing the pressure of a gas to be sealed in a tubular bulb like that of a fluorescent lamp.

BACKGROUND ART

In the manufacture of, for example, a fluorescent lamp, a gas such as argon is sealed in a tubular bulb at a prescribed pressure. One of the known gas-sealing processes is the co-called flow evacuation method which comprises introducing the same kind of gas as is to be sealed into one end of a tubular bulb in the capacity of a purge gas, thereby expelling impure gases such as air and nitrogen from the tubular bulb. After replacing the impure gases by the desired gas, an exhaust tube is sealed. With this flow evacuation method, the pressure of the purge gas in a tubular bulb during flow evacuation gives rise to variations of, for example, $5\pm2$ torr depending on the different diameters of an exhaust tube. If, in this case, the purge gas itself is introduced as a seal gas, then the pressure of the seal gas is subject to wide variations.

To avoid such an undesirable event, the conventional process comprises reducing the gas pressure in the tubular bulb to a level of about 0.5 torr after flow evacuation, introducing a desired gas into the bulb at a pressure of, for example, about 2.5 torr and thereafter sealing the exhaust tube. In this case, however, an appreciable length of time is consumed to decompress the interior of the tubular bulb (it takes about 30 seconds to reduce the gas pressure in the tubular bulb from, for example, 5 torr to a level of 0.5 torr), thus decreasing the operation efficiency of high output production. Further, this method, which comprises decompressing the interior of a tubular bulb and again sealing a gas therein, is undesirably complicated.

It is accordingly the object of this invention to provide a method and apparatus for easily and quickly stabilizing the pressure of a gas to be sealed in a tubular bulb to a prescribed level.

SUMMARY OF THE INVENTION

A seal gas pressure-stabilizing apparatus according to this invention includes a hollow body having a first pipe with a conductance $C_1$, a second pipe with a conductance $C_2$ and a third pipe with a conductance $C_3$, which communicate with each other. The conductance $C_1$ is lower than either of the conductances $C_2$ and $C_3$. The first pipe is connected to a source of the same kind of gas as that which is to be finally sealed in a tubular bulb, the second pipe to a decompressing system, and the third pipe to a tubular bulb. Under the condition in which the gas from the source constantly flows from the first pipe to the second pipe, the conductances $C_1$ and $C_2$ are set at such a level that the pressure of a gas running through the third pipe retains a level the same as or lower than a desired pressure of a gas to be sealed in the tubular bulb. The corresponding method is also a part of the present invention. Thus, this invention permits the easy setting of the pressure of a gas to be sealed in the tubular bulb.

BEST MODE OF CARRYING OUT THE INVENTION

This invention will be described below with reference to the accompanying drawings to provide a full understanding thereof.

Figure 1:
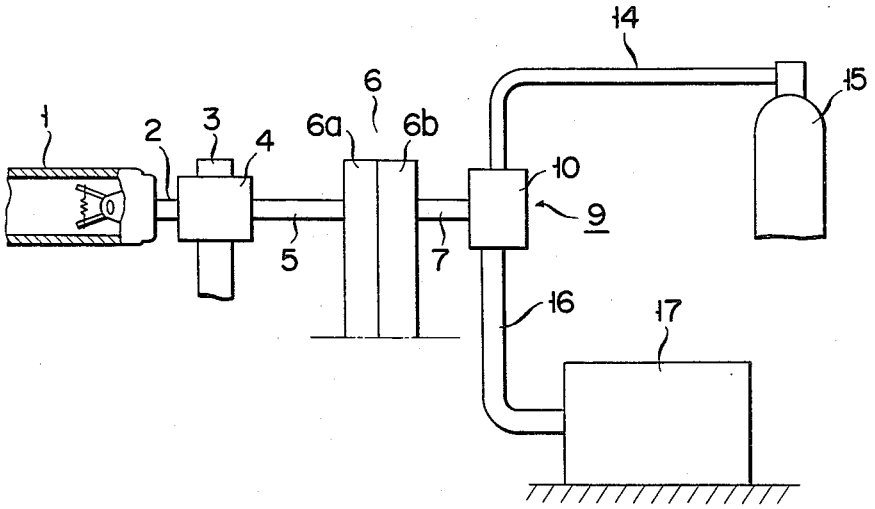
FIG. 1 schematically shows the arrangement of the whole of a gas-sealing system comprising a gas pressure-stabilizing apparatus according to this invention.

FIG. 1 schematically indicates the arrangement of the whole of a gas-sealing system comprising a gas pressure-stabilizing apparatus according to this invention. In the figure, reference numeral 1 denotes a tubular bulb of a fluorescent lamp. An one end of the bulb 1 an exhaust pipe 2 communicating with the bulb is provided. The exhaust pipe 2 is held airtight by a head 4 fixed to a spider 3 of an exhausting machine (not shown). The head 4 is fitted with a connection pipe 5 communicating with the exhaust pipe 2. The other end of the connection pipe 5 is connected to one valve member *6a* of a disc-shaped lapped rotary valve 6 referred to as a center valve. The other valve member *6b* of the rotary valve 6 is connected to a communication pipe 7. When the valve members *6a*, *6b* slidably rotate relative to each other and are respectively brought to a specified position, then the communication pipe 7 and connection pipe 5 are made to communicate with each other through the passages of the valve members.

A gas pressure-stabilizing apparatus 9 of this invention is set at the other end of the communication pipe 7. This apparatus is connected to a source 15 of the same kind of gas as is to be sealed in bulb 1 through a gas pipe 14 and also to a decompressing system 17, for example, a vacuum pump through a suction pipe 16.

Figure 2:
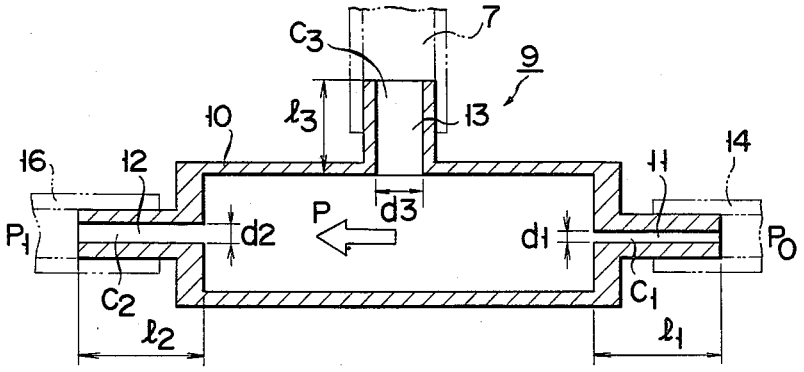
FIG. 2 is a longitudinal sectional view of the gas pressure-stabilizing apparatus according to this invention.

As best shown in FIG. 2, the seal gas pressure-stabilizing apparatus 9 comprises a hollow body 10 such as a cylindrical hollow body. A first pipe 11 having a conductance $C_1$ defined by the inner diameter $d_1$ and length $l_1$ of the pipe is provided at one end of the hollow body 10. A second pipe 12 having a conductance $C_2$ defined by the inner diameter $d_2$ and length $l_2$ of the pipe is set at the other end of the hollow body 10. A third pipe 13 having a conductance $C_3$ defined by the inner diameter $d_3$ and length $l_3$ of the pipe is disposed substantially at the center of the lateral wall of the hollow body 10. The first pipe 11 is connected to the gas source 15 through the gas pipe 14. The second pipe 12 is connected to the decompressing system 17 through the suction pipe 16. The third pipe 13 is connected ultimately to the tubular bulb 1 through the communication pipe 7. The first, second and third pipes 11, 12, 13 communicate with each other through the interior of the hollow body 10 as shown in the figure.

As previously described, the conductances $C_1$, $C_2$ and $C_3$ satisfy the relationship of $C_1<C_2$, $C_3$. In addition, the conductances $C_1$ and $C_2$ are so set that the gas pressure inside the third pipe 13 may reach a level the same as or lower than (preferably equal or similar thereto) a desired pressure level to be attained in the bulb 1 under the conditions wherein the gas from the gas source 15 constantly flows from the first pipe 11 to the second pipe 12. This arrangement is concretely described below.

Now let it be assumed that the first pipe 11 has an inner diameter of 0.3 mm; the second pipe 12 has a slightly larger diameter than 0.3 mm; for convenience, the length $l_1$ of the first pipe 11 and the length $l_2$ of the second pipe 12 are made equal; and the third pipe 13 has an inner diameter $d_3$ fully larger than the inner diameter $d_2$ of the second pipe. Then the conductances $C_1$, $C_2$, $C_3$ of the pipes 11, 12, 13 satisfy the relationship of $C_1 < C_2, C_3$. Further, let it be assumed that the pressure of a gas issued from the source 15 is expressed by $P_0$; a pressure in the hollow body 10 is denoted by P; a pressure in the decompressing system 17 is represented by $P_1$; and the relationship of $P_0 >> P > P_1$ is established. Where a balanced pressure in the hollow body 10 is determined from the resistance of a fluid at both ends of the hollow body 10. Then the following equation results:

$$\frac{d_1^4}{l_1} \times P_0^2 = \frac{d_2^4}{l_2} \times P^2$$

Assuming $P_0 = 760$ torr and $P = 2.5$ torr, then there result $d_2 = 17_{dl}$ because $l_1 = l_2$. Since $d_1$ is 0.3 mm, $d_2$ is 5.2 mm. In other words, if the equations $d_1 = 0.3$ mm and $d_2 = 5.2$ mm are established while a gas is constantly flowing from the first pipe 11 to the second pipe 12, then a gas pressure in the hollow body 10, namely, in the third pipe 13 reaches a desired level of 2.5 torr. Obviously, the length $l_1$ of the pipe 11 and the length $l_2$ of the pipe 12 need not be made equal. In such case, it is advised to set the inner diameters $d_1$ and $d_2$ (or the conductances $C_1$ and $C_2$) at such a level that a gas pressure in the hollow body 10 is made equal to or lower than the desired gas pressure which should be reached in the tubular bulb 1. It is possible to provide the first, second and third pipes respectively in a plural number.

Where, therefore, the tubular bulb 1 is made to communicate with the hollow body 10 in which there is produced a gas pressure substantially conforming with the desired gas pressure which should be reached in the tubular bulb by selecting the values of the conductances $C_1$, $C_2$, then coincidence arises between the gas pressure of the tubular bulb 1 and that of the hollow body 10. As a result, the desired gas pressure is ensured in the tubular bulb 1.

Description is given of the process of sealing a gas in the tubular bulb 1 again with reference to FIG. 1. First, the same kind of gas, for example an inert gas such as argon, as to be sealed is taken into the tubular bulb 1 by the aforesaid flow evacuation method, thereby replacing air remaining in the bulb 1 by argon gas.

The rotary valve 6 is then rotated to cause the connection pipe 5 and communication pipe 7 to communicate with each other in the valve 6, thereby forming a passageway extending between the interior of the tubular bulb 1 and that of the hollow body 10 of the seal gas pressure-stabilizing apparatus 9. At this time, an atmosphere of argon gas stream is retained in the hollow body 10 at a pressure of, for example, 2.5 torr. Therefore, the argon gas held in the tubular bulb 1 instantly begins to be expelled through the third pipe 13. As a result, a gas pressure in the tubular bulb 1 quickly drops to a gas pressure, for example, 2.5 torr in the hollow body 10, and gets stabilized at said level. In this fashion, the gas pressure required about 8 seconds to be stabilized.

After the argon gas in the tubular bulb 1 has its pressure thus stabilized at a desired pressure level, the exhaust pipe 2 is burnt off in an airtight condition by an exhaust pipe-burning off device, thereby finishing a gas-sealing step.

With the above-mentioned seal gas pressure-stabilizing apparatus of this invention, a gas pressure in the hollow body 10 is prominently stabilized at a prescribed level (for example, 2.5 torr). Where a gas is brought into the hollow body through the third pipe 13 (a higher gas pressure than 2.5 torr sometimes prevails in the tubular bulb 1 even after flow evacuation), the gas pressure regains the original level (2.5 torr) quickly (in about 8 seconds in the above-mentioned case). Therefore, the gas pressure in the tubular bulb 1 can be stabilized in a short time. It has been proved that where the seal gas pressure-stabilizing apparatus 9 of this invention was fitted to a tubular bulb-evacuating machine under high output production, the gas-sealing step consumed a far shorter time than in the past, noticeably elevating the operation efficiency as a whole. The present seal gas pressure-stabilizing apparatus 9 can set a gas pressure in the tubular bulb 1 exactly at a prescribed level without being affected even by wide variations in the gas pressure in the tubular bulb right after flow evacuation. The seal gas pressure-stabilizing apparatus 9, which has a very simple arrangement, can be manufactured easily at low cost, and retain a stable property without the possibility of failures.

This invention is applicable not only to the flow evacuation method, but also to the case in which a gas is sealed in a tubular bulb after its evacuation as practiced in the past. Further, this invention can be widely utilized as an apparatus for sealing a low pressure gas in the ordinary tubular bulb.

What we claim is:

1. Apparatus for stabilizing a gas to a predetermined pressure in a closed body comprising:

a hollow body;

a first pipe connected to said hollow body and having a conductance $C_1$, said first pipe being connected to a source of said gas;

a second pipe connected to said hollow body and having a conductance $C_2$, said second pipe being connected to a decompressing system, said first and second pipes and said hollow body directly and simultaneously interconnecting said decompressing system and said source during operation; and a third pipe connected to said hollow body and being adapted to be connected to said closed body and having a portion of least conductance $C_3$, said conductance $C_1$ being smaller than either of said conductance $C_2$ and said least conductance $C_3$, and said conductances $C_1$ and $C_2$ being so set that the gas pressure level inside said third pipe is substantially the same as said predetermined gas pressure attained in said closed body when the gas from said gas source constantly flows from said first pipe to said second pipe.

2. A system for stabilizing a gas to a predetermined pressure in a closed body comprising:

a source of said gas;

a decompressing system;

a hollow body;

a first pipe connected between said source and said hollow body and having a conductance $C_1$;

a second pipe connected between said decompressing system and said hollow body and having a conductance $C_2$, said first and second pipes and said hollow body directly and simultaneously interconnecting said decompressing system and said source during operation; and a third pipe connected to said hollow body and adapted to be connected to said closed body, said third pipe having a portion of least conductance $C_3$, said conductance $C_1$ being smaller than either of said conductance $C_2$ and said least conductance $C_3$, and said conductances $C_1$ and $C_2$ being so set that the gas pressure level inside said third pipe is substantially the same as said predetermined gas pressure attained in said closed body when the gas from said source constantly flows from said first pipe to said second pipe.

3. A method for stabilizing a gas to a predetermined pressure in a closed body comprising the steps of:

connecting said closed body to a hollow body through a third pipe having a conductance $C_3$;

supplying said gas from a source to said hollow body through a first pipe having a conductance $C_1$;

exhausting gas from said hollow body by a decompressing system through a second pipe having a conductance $C_2$ simultaneously with said supplying step, said conductances being such that $C_1$ is smaller than either of $C_2$ and $C_3$, conductances $C_1$ and $C_2$ being so set that a gas pressure inside said third pipe is substantially the same as said predetermined gas pressure attained in the closed body when said gas from said source constantly flows from said first pipe to said second pipe.

* * * * *